US006162325A

United States Patent [19]

Raslack et al.

[11] Patent Number: 6,162,325

[45] **Date of Patent: *Dec. 19, 2000**

[54] PROCESS FOR TREATING PAPER PULP

[75] Inventors: Roderick Donald Raslack, Thunder Bay, Canada; Charles Theodore Gammon, Acworth, Ga.; Reginald James Christmas, Stoney Creek, Canada

[73] Assignee: Vinings Industries, Inc., Kennesaw, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 08/951,739

[22] Filed: Oct. 16, 1997

[51] Int. Cl.[7] ..... D21C 9/02

[52] U.S. Cl. ..... 162/60; 162/72; 162/DIG. 3

[58] Field of Search ..... 162/158, 60, 57, 162/58, 72, 76; 252/321, 358, 331

[56] References Cited

U.S. PATENT DOCUMENTS

| | | | |
|---|---|---|---|
| 3,567,754 | 3/1971 | Braitberg et al. . | |
| 3,772,207 | 11/1973 | Michalski et al. . | |
| 4,024,072 | 5/1977 | Shane et al. . | |
| 4,230,599 | 10/1980 | Elfers . | |
| 4,303,549 | 12/1981 | Boylan . | |
| 4,340,500 | 7/1982 | Boylan . | |
| 4,950,420 | 8/1990 | Svarz . | |
| 4,960,540 | 10/1990 | Friel, Jr. et al. . | |
| 5,152,925 | 10/1992 | Furman . | |
| 5,320,777 | 6/1994 | Nguyen et al. . | |
| 5,326,499 | 7/1994 | Wegner et al. . | |
| 5,429,718 | 7/1995 | Morlino et al. . | |
| 5,562,862 | 10/1996 | Bersansky, Jr. et al. . | |
| 5,601,752 | 2/1997 | Jenkins | 252/321 |

OTHER PUBLICATIONS

Pelton, R., "A review of brownstock defoamer fundamentals", Pulp & Paper Canada 90:2 (1989), pp. 61–67.

Korhonen, O., "Brownstock washing: A review of current technology,", Pulp & Paper, Sep., 1979, pp. 104–107.

*Primary Examiner*—James Derrington
*Assistant Examiner*—Robert McBride
*Attorney, Agent, or Firm*—Alston & Bird LLP

[57] ABSTRACT

Disclosed is a process for washing or otherwise treating paper pulp. More specifically, a multi-stage paper pulp washing process including the use of a defoamer/emulsifier mixture which is adjusted at a paper manufacturing site for each stage. The same defoamer may be used in each washing stage. However, solubility is adjusted at the paper manufacturing site by adding a small amount of emulsifier to the defoamer as appropriate for the particular stage.

13 Claims, 6 Drawing Sheets

PROCESS FOR TREATING PAPER PULP

The present application claims priority under 35 USC §119 from U.S. provisional patent application Ser. No. 60/030,556 filed Nov. 14, 1996, incorporated herein by reference.

FIELD OF THE INVENTION

The present invention relates to a process for treating, e.g., washing, paper pulp. More specifically, the present invention relates to a multi-stage paper pulp washing process including the use of a defoamer/emulsifier mixture which is adjusted for each stage. This new process employs "on-line emulsifying." The same defoamer is used in each washing stage. However, solubility is adjusted by adding a small amount of emulsifier to the later stages. The present invention has the advantage of providing paper pulp plant operators with flexibility to easily adjust treating chemical composition to account for changes in feedstock without changing the treating chemicals that are stored at the plant site.

BACKGROUND OF THE INVENTION

In the paper industry, the kraft process is valuable for paper production. The kraft process as taught by U.S. Pat. No. 3,245,635 to Liebling is generally described as being performed by first cooking the wood chips in digesters and then drawing off the spent chemicals for reuse. The resulting pulp fibers are then screened and then washed free in brownstock washers of a large amount of residual chemicals. These brownstock washers are a series of stages, typically vats, usually three or four in number which alternatively dilute the pulp with water and thicken it by picking it up on large rotary screens. In the conventional kraft paper making process the above-described brownstock washing step is performed in a stage or a series of stages (e.g., three or four stages) in which the water travels countercurrent to the pulp. Typically, there is one vessel, e.g., vat, employed per stage 10, 20, 30, 40 as shown by FIG. 1.

The upstream stages, e.g., stage 10, have high solids concentration, e.g., 10–20%, high pH, over 12 due to base, e.g., sodium hydroxide or potassium hydroxide, employed during delignification processing, and high temperature, about 190° F. The downstream stages, e.g., stage 40, have low solids concentration, e.g., 0.1–0.3%, lower pH, ranging from about 8–12, e.g., 8–10, and lower temperature, about 120° F. These stages all employ defoamers. However, because of the differing conditions, the prior art employed different defoamers in the different stages. Brownstock defoamer is employed in the earlier stages, e.g., stage 10, and screen room defoamer is employed in the later stages, e.g., stage 40. Screen room defoamer is similar to brownstock defoamer except that screen room defoamer includes emulsifier. To employ the same defoamer in all the stages would avoid optimum performance because in the first stage the high temperature, high solids content and high pH help to distribute the insoluble defoamer throughout the black liquor and brownstock in each stage. However, these factors are not present in the later stages, e.g., stage 40. The later stages are colder, have less solids and are less foamy than the earlier stages.

From the brownstock washer stage 40, the clean pulp travels to the screen room where it is again diluted with water and put through vibrating screens which now accept the completely delignified fibers and reject clumps of unpulped fibers, knots, and other foreign material. Rejected material is recycled to delignification. Foam problems are severe in the brownstock washer vats since the diluted pulp is subjected to violent agitation by the rotary screens. Foam problems are also severe in the screen room since the diluted pulp is subjected to violent agitation by the screens. The water removed from the pulp after the screening operation is referred to as the dilute black liquor and, for the sake of economy, is normally used as the dilution water for the third and fourth stage of the brownstock washers. The dilute black liquor is a foaming material, containing from about 0.001% to 0.1% by weight of solids and has a pH of about 12. The foaming of the dilute black liquor increases with the resin content of the wood used in this process. After processing in the screen room, the pulp is processed in a decker. If whitening the brownstock is desired, then, the brownstock pulp is sent to a bleach plant, which typically includes one or more bleaching units and one or more caustic treating units.

Defoamers are generally used in most alkaline pulp mills during the brownstock washing, screening and bleaching operations so that more efficient washing, screening and bleaching, respectively are accomplished.

Another kind of pulp washing apparatus is known as a horizontal belt washer. A typical such washer is shown on FIG. 2 and described in Handbook For Pulp & Paper Technologists, prepared under the direction of the Joint Textbook Committee of the Paper Industry, G. A. Smook, Author, M. J. Kocurek, ed., (1982), available from TAPPI, Technology Park/Atlanta, P.O. Box 105113 Atlanta, Ga. 30348.

Pulp slurry containing up to 3.5% pulp is distributed across a traveling endless "wire" 102 (FIG. 2). The pulp is dewatered, forming a mat of about 8% to 12% solids.

The washer device 100 includes wire 102 and suction boxes 110, 120, 130, 140, 150, 160. Water is showered on the wire 102 over the suction boxes.

This pulp is then washed in a series of displacement stages as the pulp travels from the headbox 104 to the couch roll 106. The wire 102 passes along roll 103, 105 and 106. The mat's consistency remains constant at 8% to 12% during these washing stages.

The cleanest wash water is added in the final shower over suction box 160 ahead of the couch roll 106. Then water is drained through the wire 102 with suction box 160, then sent to the previous shower over the previous suction box 150. The filtrate from the first shower over suction box 120 is finally sent to the evaporators. Filtrate drained ahead of the first shower is used for dilution of furnish in headbox 104.

Belt washers, thus, use one dilution/extraction stage, followed by several displacement stages. These are all termed "wash zones" for purposes of this specification. Theoretically, a large number of displacement stages can be fit along the wire 102. Horizontal belt washers are supposed to give high overall washing efficiencies at comparatively low dilution factors.

The wire 102 on the belt washer can be of three basic designs. It can be a grooved rubber belt, a woven plastic filament belt, or made of a thin sheet of solid stainless steel, which has been perforated and welded to become a continuous belt. Typically washer 100 includes a hood 200.

It would be desirable to provide one defoamer and one emulsifier that could each be stored in a respective tank at the paper manufacturing site and employed in all of the above-described staged pulp treating operations as appropriate.

Moreover, paper pulp plants have a need for flexibility. The treating chemicals at one plant are not necessarily effective at another plant. Sometimes this lack of effectiveness is due to different feedstock being processed at the different plants. Also, even at the same plant, changes in feedstock can lead to a need to change treating chemicals. It would be desirable to provide a process where the same chemicals could be used at a variety of plants and with a variety of feedstocks.

SUMMARY OF THE INVENTION

It is an object of the present invention to provide a paper pulp washing process that facilitates paper plant operation.

Most pulp mills use one oil based (or water extended) defoamer to promote drainage on all stages of pulp washing; including the decker. Due to reduced solids and emulsifying capability in the latter stages, the defoamer is not distributed efficiently into the stock. This results in reduced defoaming performance and can also lead to increased deposit formation. The present invention provides an on-line emulsifying system which modifies the oil based defoamer so that it is readily dispersible in the various latter stage liquors. Field evaluations have documented more efficient drainage, reduced usage, and elimination or reduction of pitch formation.

The present invention employs the same defoamer in all three or four washing stages. However, it employs on-line solubility adjusting by adding a small amount, e.g., 0.2–20%, typically 1–5%, preferably 1–3%, of emulsifier to the later stages. The emulsifier compensates for the lack of solubility of the defoamer due to the low solids content, low pH and low temperature liquors.

The defoamer is a conventional pulp mill defoamer which is insoluble in water. A conventional defoamer comprises mineral oil carrier, hydrophobic silica, ethylene bis-stearamide, various polymers, e.g., acrylic polymers or propoxylates, and silicone oil. The defoamer preferably does not contain ethylene bis-stearamide (EBS). EBS is an effective defoamer but it is a pitch precursor and thus can lead to deposits on mill machinery and in the finished pulp or paper sheet. Users of EBS-containing defoamers benefit from the present invention which lowers the propensity of EBS-defoamer related deposition occuring downstream.

The emulsifier could be anionic, cationic or non-ionic, but is preferably a non-ionic emulsifier. Typical non-ionic emulsifiers include polyethylene glycol ester, ethoxylates or propoxylates.

The defoamer and emulsifier may be mixed before being injected into the later washing stages. Preferably, the defoamer and emulsifier are mixed in a static in-line mixer.

The advantage of the present invention is that a paper plant can use a single tank to store the defoamer, use a much smaller tank to store the emulsifier, and easily custom mix the two ingredients at the plant site. In addition to the later washing stages, the defoamer/emulsifier mixture may be employed in the screen room and, in some cases, i.e., liner board manufacture, even on the paper machine.

These and other objectives and advantages will be apparent from the following description of the presently preferred embodiments of the present invention.

BRIEF DESCRIPTION OF THE DRAWINGS

In all the figures, like elements are designated by like numerals.

DETAILED DESCRIPTION OF THE PREFERRED EMBODIMENTS

Figure 1:
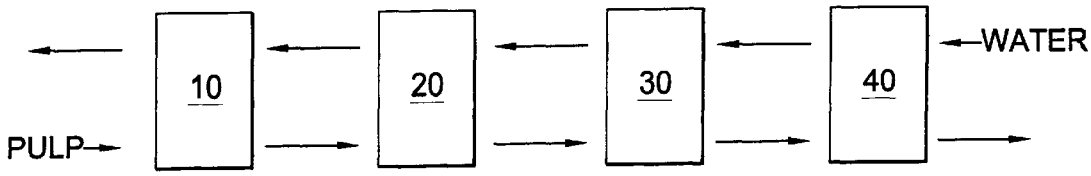
FIG. 1 shows process flow diagram for the washing step of a conventional kraft process.
Figure 2:
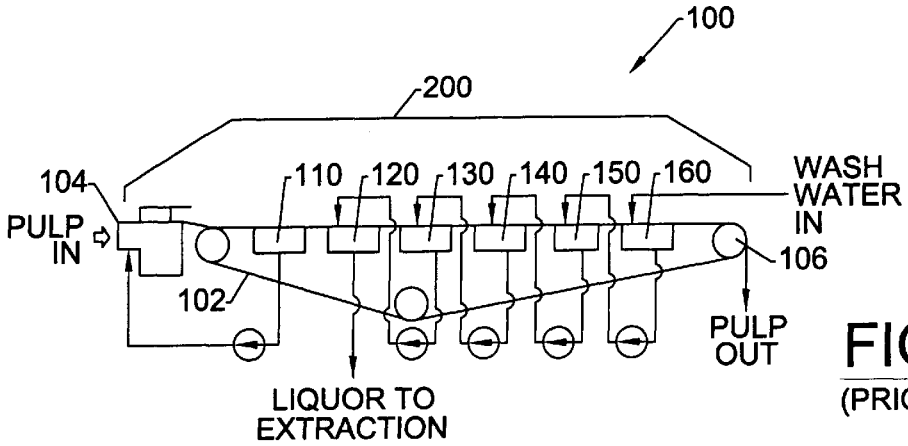
FIG. 2. (PRIOR ART)
FIG. 2 shows a conventional horizontal belt washer.

Generally the present invention provides a process for cleaning, e.g., washing, paper pulp at a paper manufacturing site. A Process for cleaning paper pulp in a vessel at a paper pulp treating plant site comprising the steps of: providing a first container for containing a defoamer; providing a second container for containing an emulsifier; feeding paper pulp into a vessel; determining a first effective feed rate for feeding the defoamer to the vessel; determining a second effective feed rate for feeding the emulsifier to the vessel; metering the defoamer at the first effective feed rate from the first container; metering the emulsifier at the second effective feed rate from the second container; mixing the metered defoamer and the metered emulsifier to form a mixture; and feeding the mixture into the vessel to mix with the paper pulp in the vessel.

More particularly, the process comprises passing paper pulp through a series of washing stages, passing a defoamer into at least two of the stages, passing emulsifier into at least one of the stages which is downstream, relative to a direction of paper pulp flow, of another of the stages to achieve an emulsifier concentration, wherein the emulsifier and a portion of the defoamer are mixed at the manufacturing site, and wherein the lowest concentration of emulsifier passed into any of the stages is at most 0 to 30% of the emulsifier concentration passed into the stage being fed the highest emulsifier concentration. As a shorthand notation, for purposes of this specification, the stage (or stages) which are fed as emulsifier may be termed "emulsifier stages." Also, for purposes of this specification, this emulsifier is defined as added emulsifier, i.e., emulsifier added at the paper manufacturing plant site, and should be distinguished from emulsifier/surfactant in the defoamer shipped to the paper manufacturing plant site or otherwise naturally present in the paper pulp stream. The emulsifier and a portion of the defoamer are mixed at the plant site. Typically, more emulsifier is added to downstream stages than to upstream stages. In some instances, the concentration of emulsifier does not decrease from one of the stages to the next stage downstream. However, the process may be employed to mix defoamer and emulsifier at the paper manufacturing site to deliver the precise amount of defoamer and emulsifier most appropriate to various process units, e.g., brownstock washing stages, at the paper manufacturing site.

The process mixes defoamer and emulsifier at the paper manufacturing site so that the same defoamer and emulsifier may be used by merely adjusting the ratio of defoamer to emulsifier, to accommodate different requirements of each of the different process units at the paper manufacturing site. Also, the ratio of defoamer to emulsifier can be adjusted at the paper manufacturing site to accommodate changes in wood feedstock. Thus, by employing the same two tanks, one for a defoamer and another for emulsifier, a paper plant operator can customize the defoamer/emulsifier ratio for each unit without changing the supplier or particular defoamer or emulsifier purchased for the paper plant. This makes paper plant operation easier and more predictable.

Figure 3:
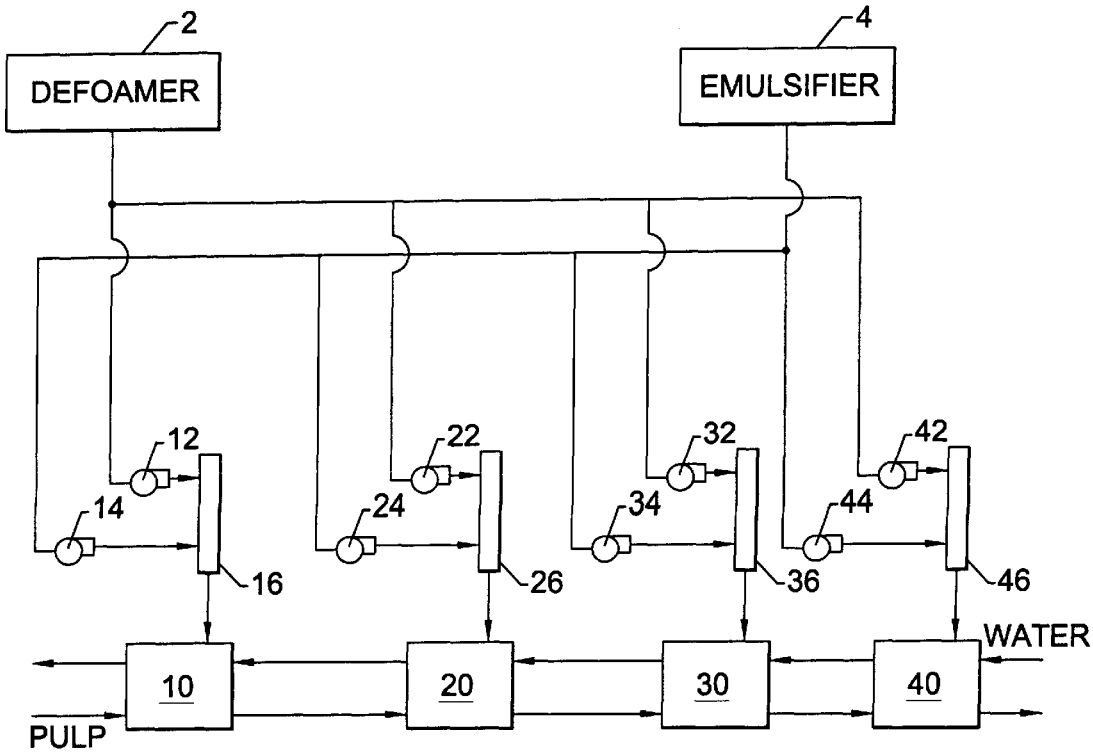
FIG. 3 shows a process flow diagram for the washing step of a kraft process modified according to the present invention.

FIG. 3 shows a process flow diagram of a process employing the present invention. The present invention may be employed in the kraft paper making process or other paper making processes, e.g., bleaching.

Liquor in the first stage 10 contains about 10–20% solids. The brownstock washer stages 10, 20, 30, 40 are typically rotary vacuum washers. The liquor in the last stage 40 typically has only about 0.1 to about 0.3 wt. % solids. The earlier stages, e.g., Stages 10, 20 are typically at high (>12) pH because base, e.g., sodium hydroxide or, less preferably, potassium hydroxide, was added upstream for delignification in the digesters (not shown). Typically, in the present paper pulp cleaning process, the paper pulp passes through the stages countercurrent to a washing fluid.

The present invention employs the same defoamer in all four washing stages 10, 20, 30, 40. However, it employs on-line solubility adjusting by adding a small amount, e.g., 0.2–20%, typically 1–5%, preferably 1–3%, of emulsifier to the later stages 30, 40 or at least to later stage 40. For example, a four stage softwood kraft mill could employ 3% of emulsifier to stage 3 and 5% of emulsifier to stage 4. The emulsifier compensates for the lack of solubility of the defoamer due to the low solids content, low pH and low temperature.

Emulsifier levels will differ with different wood species and this emphasizes a major advantage of the present invention. The present invention provides a kraft plant with the flexibility to operate well with a variety of wood species.

The defoamer is a conventional defoamer which is insoluble in water. A conventional defoamer comprises mineral oil carrier, hydrophobic silica, ethylene bis-stearamide, various polymers, e.g., acrylic polymer or propoxylates, silicone surfactants, and silicone oil. Numerous defoamers are disclosed by U.S. Pat. No. 5,045,232 to Dahanayake, U.S. Pat. No. 4,950,420 to Svarz and U.S. Pat. No. 4,024,072 to Shane et al, all of which are incorporated by reference in their entirety. The defoamer preferably does not contain ethylene bis-stearamide (EBS). EBS is an effective defoamer but it is a pitch precursor and thus can lead to deposits on mill machinery and in finished pulp paper. A preferred EBS-free defoamer is FLEETCOL 9189 defoamer, a product of Rhone-Poulenc Inc., Cranbury, N.J. Typically, FLEETCOL 9189 defoamer is employed in the early brownstock washing stage. OG-48 defoamer, i.e., FLEETCOL 9189 defoamer mixed with emulsifier at the paper pulp processing site, is employed in later brownstock washing stages, and may be employed in the screen room stage. Another EBS-free defoamer is disclosed by U.S. Pat. No. 5,152,925 to Furman incorporated herein by reference in its entirety.

The emulsifier is generally added to the defoamer composition in an effective amount sufficient to disperse the defoamer composition as discrete particles in the aqueous medium in which it is to function. Preferably, the added emulsifier is present generally in the proportion of about 1 to about 20 percent by weight based upon the total weight of said defoamer composition. Thus, the mineral oil-ester composition of the invention can be made more readily dispersible in aqueous media and also more effective as a defoamer by the incorporation of emulsifier. Defoamers may be shipped to the paper manufacturing plant with a small amount of surfactant, e.g., silicon-containing surfactants, to enhance performance, but this differs from the added emulsifiers. Generally, the emulsifier utilized has a measure of mineral oil solubility and is preferably selected from at least one of compositions such as fatty ester alkoxylates, e.g., polyethylene glycol esters, and polyoxyalkylene glycols. The glycols desirably have a suitable hydrophobic component of the molecule which confers mineral oil solubility or at least mineral oil dispersibility. The polyoxyalkylene glycols are well known in the emulsifier art and generally have a molecular weight of about 100 to about 5000.

The emulsifier utilized as a component of the defoamer compositions of the invention, generally can be selected from any of the various types of emulsifiers include anionic, cationic, and non-ionic emulsifiers. Examples of suitable anionic emulsifiers are fatty acids containing about 12 to about 22 carbon atoms and soaps of the fatty acids. Other suitable anionic emulsifiers include alkali metal and alkaline earth metal salts of alkyl-aryl sulfonic acids and sulfated or sulfonated oils.

Suitable cationic emulsifiers include salts of long chain primary, secondary, or tertiary amines and quaternary salts.

Preferably, the emulsifier is a non-ionic emulsifier. Suitable non-ionic emulsifiers include the above-mentioned polyoxyalkylene glycols as well as alkoxylated alkyl substituted phenols, condensation products of higher fatty alcohols with ethylene oxide, condensation products of fatty acid amides with ethylene oxide, polyethylene glycol esters of long chain fatty acids, ethylene oxide condensates of a polyhydric alcohol, partial higher fatty acid esters and their inner anhydrides, long chain polyglycols in which one hydroxyl group is esterified with a higher fatty acid and the other hydroxyl group is esterified with a low molecular weight alcohol and copolymers of ethylene oxide and propylene oxide. Additional non-ionic emulsifiers include sorbitans, SPAN (available from ICI Specialty Chemicals, New Castle, Del.), TWEEN (available from ICI Specialty Chemicals, New Castle, Del.), lecithin and ethoxylated lecithin.

Preferred non-ionic emulsifiers include polyethylene glycol ester, ethoxylates or propoxylates.

One particular type of emulsifier which can be used is a petroleum sulfonate of molecular weight from about 400 to about 600, such as calcium petroleum sulfonate. Calcium petroleum sulfonates are commercially available, a typical such product being SURCHEM 306, typically having a molecular weight of about 440.

Another particular type of emulsifier which may be used is an alkoxylated alkyl phenol of the formula:

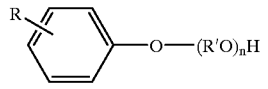

where R is an alkyl group, typically containing from 8 to 10 carbon atoms, particularly the n-nonyl group, usually located in the para position to the oxygen, R' is an alkyl group containing two or three carbon atoms, especially two carbon atoms, and n is a value from greater than 4 to less than about 8, typically about 6.

As the alkoxylated alkyl substituted phenol, it is typical to use an ethoxylated p-nonyl phenol containing about 6 ethylene oxide groups. This material may be designated:

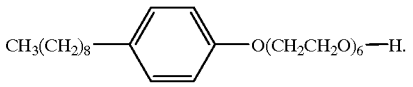

This product is available in commercial form as IGEPAL CO-530 emulsifier from Rhone-Poulenc, Cranbury, N.J.

A further type of emulsifier which may be used is an alkoxylated hydrogenated tallow amine, particularly an ethoxylated hydrogenated tallow amine. Materials of this type are commercially-available, typically as DYESPERSE 323B.

Copolymers of ethylene oxide and propylene oxide of various form may also be used as a emulsifier in the compositions of the invention. Copolymers of this type are commercially available as ANTAROX L-62 emulsifier from Rhone-Poulenc, Cranbury, N.J. The copolymer may be in the form of randomly-copolymerized chains, copolymerized blocks of polyethylene oxide and polypropylene oxide with varying chain lengths in the blocks and varying numbers of blocks and copolymerized blocks of polyethylene oxide or polypropylene oxide and blocks containing randomly connected propylene oxide and ethylene oxide units.

The total quantity of defoamer and emulsifier used in the composition of the invention may vary widely depending on the particular defoamer components used and the emulsifier used.

Preferably, the defoamer and emulsifier may be mixed, most preferably in a static in-line mixer before being injected into the washing stages. Then the defoamer/emulsifier composition is added to the brownstock washing system. The defoamer composition typically is added to the system neat.

FIG. 3 shows a schematic of a typical system of the present invention. Metered amounts of defoamer is continuously pumped from a defoamer storage tank 2 through pumps 12, 22, 32, 42 to static mixers 16, 26, 36, 46, respectively while emulsifier is continuously pumped from an emulsifier storage tank 4 through pumps 14, 24, 34, 44 to the static mixers 16, 26, 36, 46, respectively. In the static mixers 16, 26, 36, 46, the defoamer and emulsifier are intimately mixed to respectively form a dispersion. The dispersion from each mixer 16, 26, 36, 46 is then fed to the respective brownstock washer stage 10, 20, 30, 40.

Figure 4:
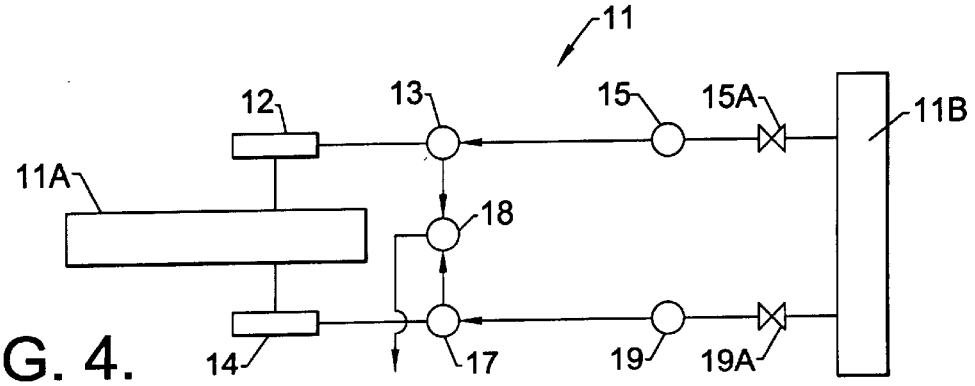
FIG. 4 shows a process flow diagram of a feed system of the present invention.

FIG. 4 shows a system including a dual head pump 11 which can be employed to pump both defoamer and emulsifier. For example, in the dual head pump 11, a single motor 11A powers pump drives 12 and 14. Emulsifier passes from a common header 11B through a valve 19A into a draw down cylinder 19 (for calibration), into a pump head 17 and then out the pump head 17 into the static mixer 16 where it mixes with defoamer. The defoamer is supplied as follows. Defoarner from the common header 11B passes through a valve 15A, into a draw-down cylinder 15, into a pump head 13 and then out the pump head 15 into the static mixer 16. Valves 15A, 19A control flow of defoamer and emulsifier, respectively.

Figure 5:
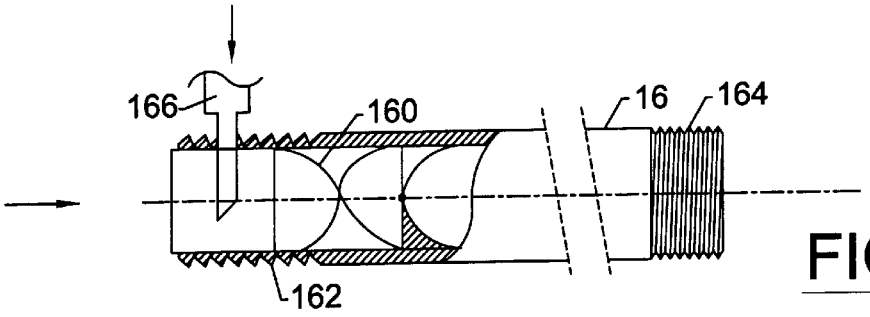
FIG. 5 shows a partial cross-sectional view of a static in-line mixer employed in the present invention.

FIG. 5 shows a view of a typical static mixer 16. The mixer 16 is essentially a pipe with a spiral lining 16 within its inner surface and optionally threaded ends 162, 164. Defoamer feeds the mixer 16 longitudinally and emulsifier feeds the mixer 16 through a conduit, e.g., quill, 166. The spiral lining 160 causes liquids within the mixer 16 to swirl and mix.

Figure 6:
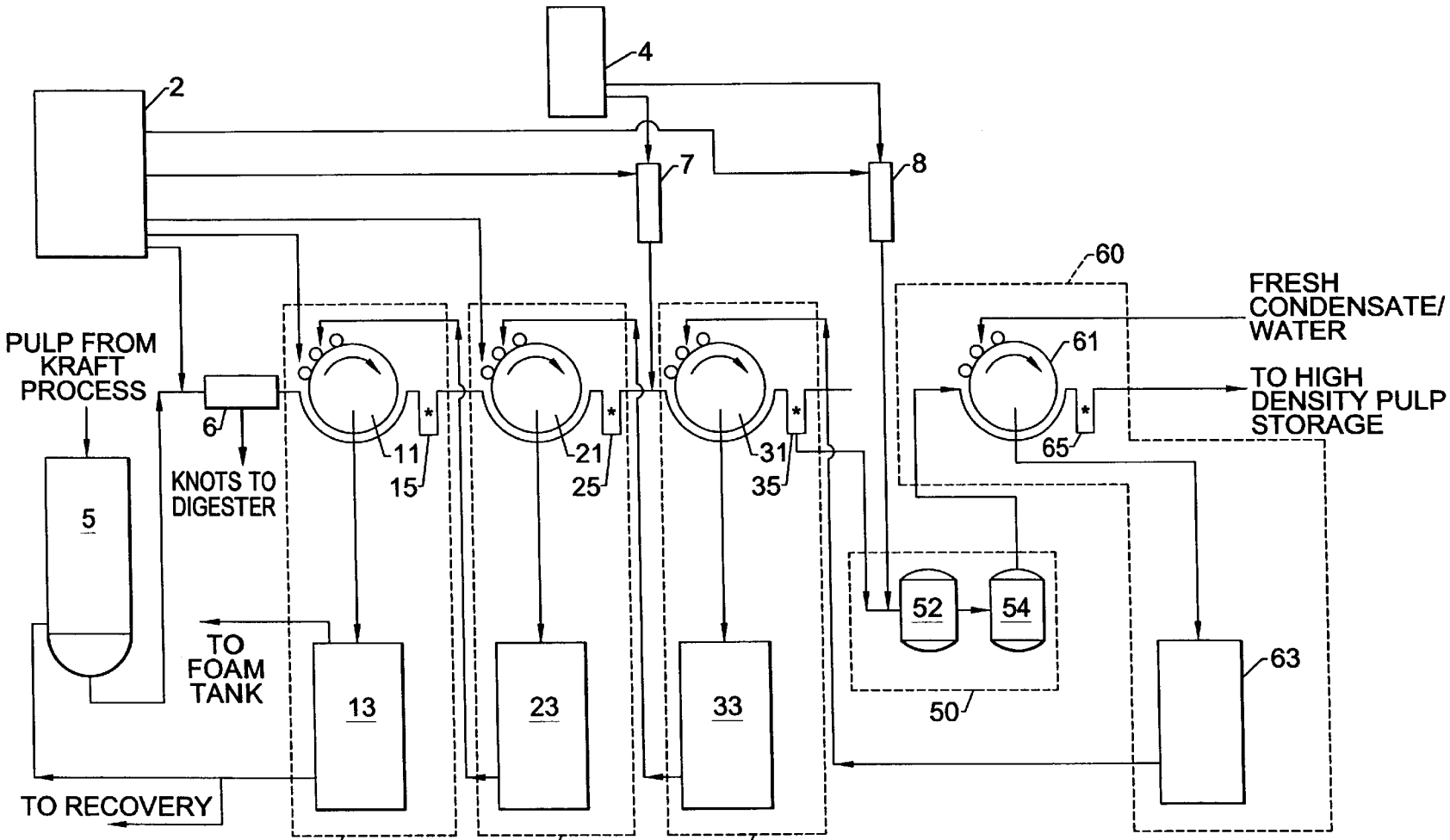
FIG. 6 shows a process flow diagram of a second embodiment of the present invention.

FIG. 6 shows an embodiment of the present invention for a three-stage washer system with a decker.

In the embodiment of the process of the present invention shown in FIG. 6, pulp, fed to a blow tank 5, feeds a knotter 6, which removes knots from the pulp. The pulp then proceeds through brownstock washer stages 10, 20 and 30. The upstream stages, e.g., stage 10, have high solids concentration, e.g., 10–20%, high pH, over 12 due to base, e.g., sodium hydroxide or potassium hydroxide, employed during delignification processing, and high temperature, about 180° F. Stage 20 operates at about 160° F. The downstream stages, e.g., stage 30, have low solids concentration, e.g., 0.1–0.3%, lower pH, ranging from about 8–10 and lower temperature, about 140° F. Each stage 10, 20, 30 employs a rotary screen 11, 21, 31, a filtrate tank 13, 23, 33 for collecting wash liquor, and a repulper vessel 15, 25, 35. These stages all employ defoamers.

From the brownstock washer stage 30, the clean pulp travels to the screen room 50 where it is again diluted with water and put through vibrating screens which now accept the completely delignified fibers and reject clumps of unpulped fibers, knots, and other foreign material. Rejected material is recycled to delignification. Foam problems are severe in the brownstock washer vats since the diluted pulp is subjected to violent agitation by the rotary screens. Foam problems are also severe in the screen room 50 (see FIG. 6) since the diluted pulp is subjected to violent agitation by the screens. Screen room 50 has stages 52, 54. The water removed from the pulp after the screening operation is referred to as the dilute black liquor and, for the sake of economy, is normally used as the dilution water for the third stage of the brownstock washers. The dilute black liquor is a foaming material, containing from about 0.001% to 0.1% by weight of solids and has a pH of about 12. The foaming of the dilute black liquor increases with the resin content of the wood used in this process. After processing in the screen room 50, the pulp is processed in a decker 60. The decker 60 includes a rotary screen 61, a decker filtrate tank 63, and a repulper vessel 65. A typical decker filtrate tank temperature is about 130° F. The cleaned pulp from the decker repulper vessel 65 then is sent to high density pulp storage (not shown). If whitening the brownstock is desired, then, the brownstock pulp is sent to a bleach plant, which typically includes one or more bleaching units and one or more caustic treating units.

The defoamer is supplied from defoamer tank 2 and the emulsifier is supplied by the emulsifier tank 4. The defoamer mixes with emulsifier in on-line static mixers 7, 8 as shown in FIG. 6 prior to being fed to stage 30 and screen room 50.

A significant advantage of the present process is that different ratios of defoamer to emulsifier can be continuously fed to each static mixer associated with each brownstock washer stage or other piece of equipment for pulp treating. Thus, for example, the ratio of emulsifier to defoamer is increased for progressively downstream (relative to the direction of pulp travel) brownstock washer stages to achieve improved operation.

The present invention is especially useful in processes involving:

1. Brownstock washer or screenroom Defoamers
2. Excessive defoamer usage in latter brownstock washer stages
3. Difficult decker applications
4. Cooler stages with high EGT (Entrained Gas Tester) Values or high entrained air values
5. One product format criteria
6. Defoamer related Pitch concerns
7. Desire zero-EBS results with an EBS product The present invention is beneficial because it brings the defoamer plant to the mill. It offers defoam & antifoam control mechanisms and lowers propensity of defoamer related deposition. It allows for a one product format and reduces deposit control chemicals usage and costs. It can be as dynamic as the mill system and thus, enhances flexibility. Also, it is more efficient at lower temperatures. In general, it is a cost effective approach.

The present invention is further described by the following non-limiting example.

EXAMPLES

Example 1

Figure 7:
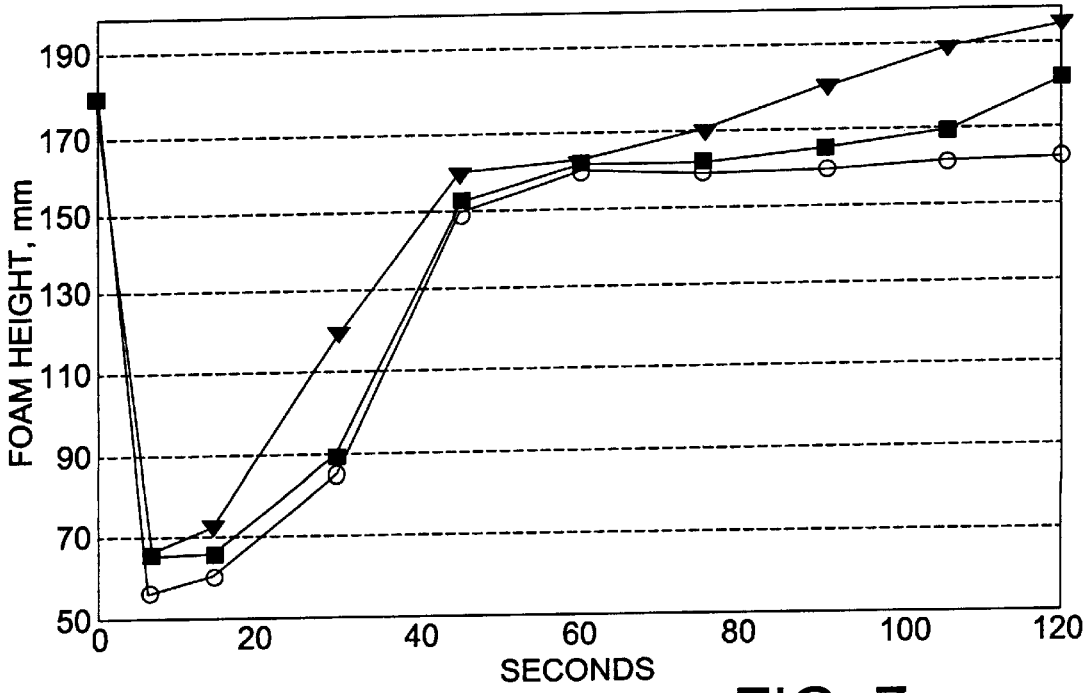
FIG. 7 shows $ClO_2$ filtrate defoaming data.

A comparison of defoaming performance in a foam cell of FLEETCOL PZ 56 defoamer available from Rhone-Poulenc, Cranbury, N.J. with and without additional emulsifier, on $ClO_2$ filtrate was made. This filtrate was from a bleaching step. The pH of the $ClO_2$ filtrate was 2.5. The pH was not adjusted for the foam cell testing. The defoamers were used at a rate of 20 microliters per 275 milliliters of filtrate. The samples were heated to 125° F. before addition to the foam cell and allowed to cool during the two minute test cycle. This simulates the 117° F. operating temperature of a typical brownstock washing stage. The pulp was started and the foam was allowed to reach 18 cm height at which point the defoamer was added and a stop watch was started. Reading were taken at 7 seconds, 15 seconds and subsequent 15 second intervals for two minutes. The data is shown by Table 2, as well as by FIG. 7.

The data shows that standard PZ 56 had knock down identical to the product of Drew Industrial, Boonton, N.J., a division of Ashland Chemical. PZ-56 is an EBS/silica/oil defoamer. The Drew product is also an EBS/silica/oil defoamer. The Drew product had superior hold down. PEG 600 dioleate emulsifier was also employed in this example. When 2% emulsifier was added to the PZ 56, the knock down improved significantly as did the hold down. Knock down is defoaming capability whereas hold down is anti-foaming capability by which the foam is prevented from the occurring. With the addition of the emulsifier, the modified PZ 56 was superior to the Drew product in both knock down and hold down on $ClO_2$ filtrate defoaming. The viscosity of the defoamer was about 1000 centipoise. The emulsifier had a viscosity of about 200 centipoise.

TABLE 1

| | Seconds 117° F., pH 2.4 | | | | | | | | | |
|---|---|---|---|---|---|---|---|---|---|---|
| | 0 | 7 | 15 | 30 | 45 | 60 | 75 | 90 | 105 | 120 |
| Drew | 180 | 65 | 65 | 89 | 152.5 | 160 | 161.5 | 164 | 167.5 | 181.5 |
| PZ 56 | 180 | 65 | 72 | 119 | 159.5 | 161.5 | 168 | 179 | 189 | 194 |
| PZ 56 + 2% 820D | 180 | 56 | 60 | 84.5 | 149 | 159 | 159 | 159 | 160 | 162 |

Example 2

Into a commercial size, 4 stage, brownstock washing system, a stream, of 3 weight percent concentration unbleached paper pulp in cooking liquor, having a pH of about 12.5, from a digester was fed to a first stage of the brownstock washing system. PX-94 defoamer (Rhone-Poulenc) was also fed to the first stage. The first stage temperature was over about 185° F. Liquor was drawn off and a first stage paper pulp effluent stream discharged from the first stage. The first stage paper pulp effluent stream had a paper pulp concentration of about 10–15 weight percent. This first stage effluent was then diluted with filtrate liquor from the second stage and PX-94 defoamer was also fed to the second stage. The second stage temperature was about 165° F. Liquor was drawn off to form a second paper pulp effluent stream containing about 10–15 weight percent paper pulp. The second stage paper pulp effluent stream was then diluted with filtrate liquor from the third stage to a concentration of about 3% pulp and then fed to the third stage. PX-94 defoamer mixed by a static mixer with 2% (based on defoamer weight) emulsifier was also fed to the third stage. In the third stage, the pulp was washed with filtrate liquor drawn from the fourth stage. The third stage operated at a temperature of about 140° F. This resulted in a third paper pulp effluent stream containing about 10–15% paper pulp. This third effluent stream was diluted with filtrate liquor drawn from the fourth stage to a 3% paper pulp concentration and fed to the fourth stage. Neither PX-94 defoamer nor emulsifier was fed to the fourth stage. In the fourth stage, the pulp was washed with liquor drawn from the screen room. This resulted in a fourth paper pulp effluent stream.

In the latter stages, i.e., stages 3 and 4, there was less solids in the liquor due to the counter-current flow of pulp and wash liquor. In most cases the foam characteristics also changed. Due to the lower solids the defoaming product controlled entrained air as opposed to surface foam in the earlier stages. The addition of approximately 2% emulsifier to the third stage turned the PX-94 water soluble. This made the product more effective by promoting the coalescence of small bubbles into larger less stable ones (gas release) by getting into the water phase for treatment. In other words, by adding the emulsifier before a static mixer, the product changed its foam control mechanism from "defoaming" to "antifoaming". In this mill about 10% reduction in usage to the 3rd stage occurred since adding emulsifier.

Figure 8:
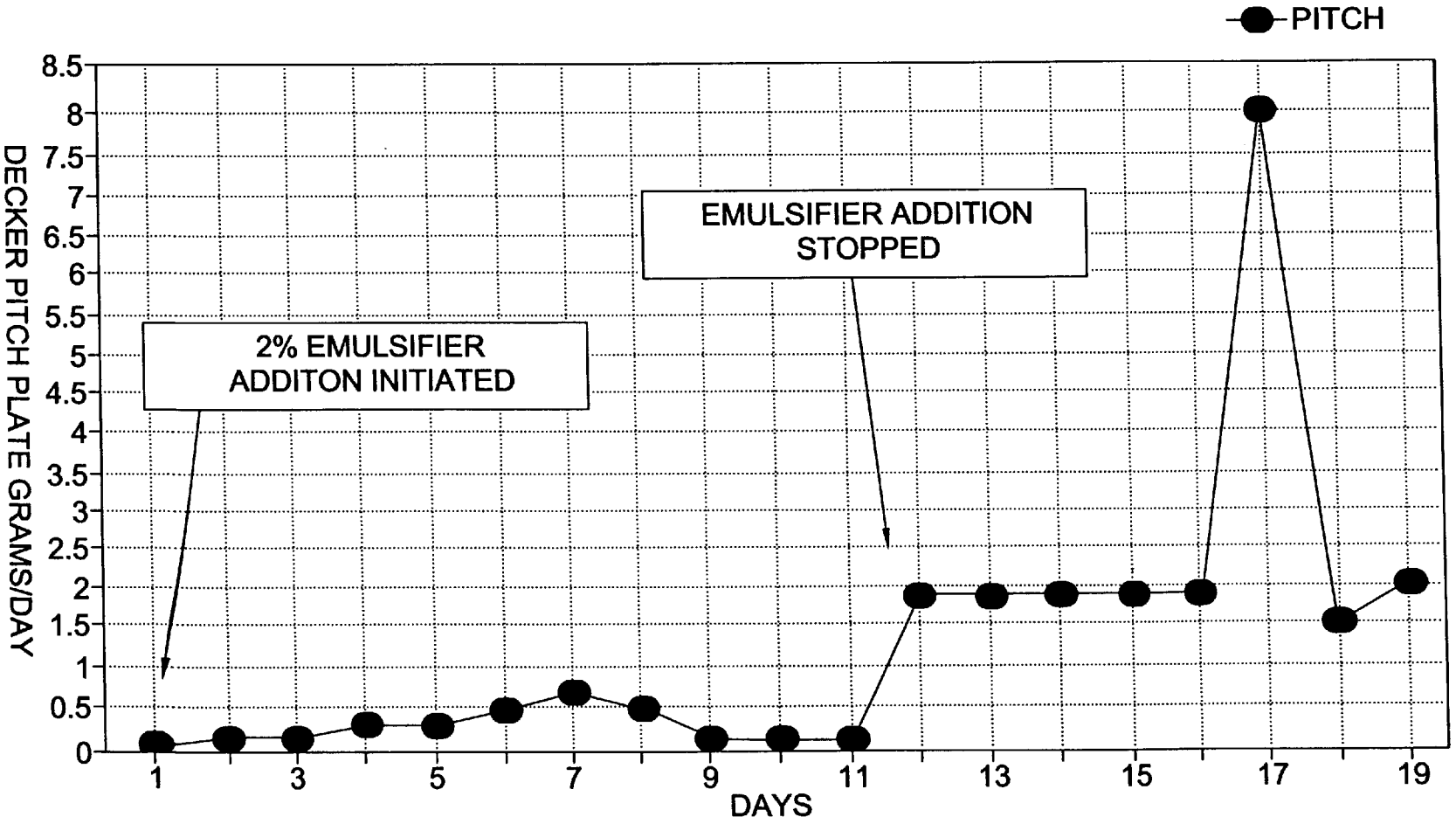
FIGS. 8–10 show pitch data.
Figure 9:
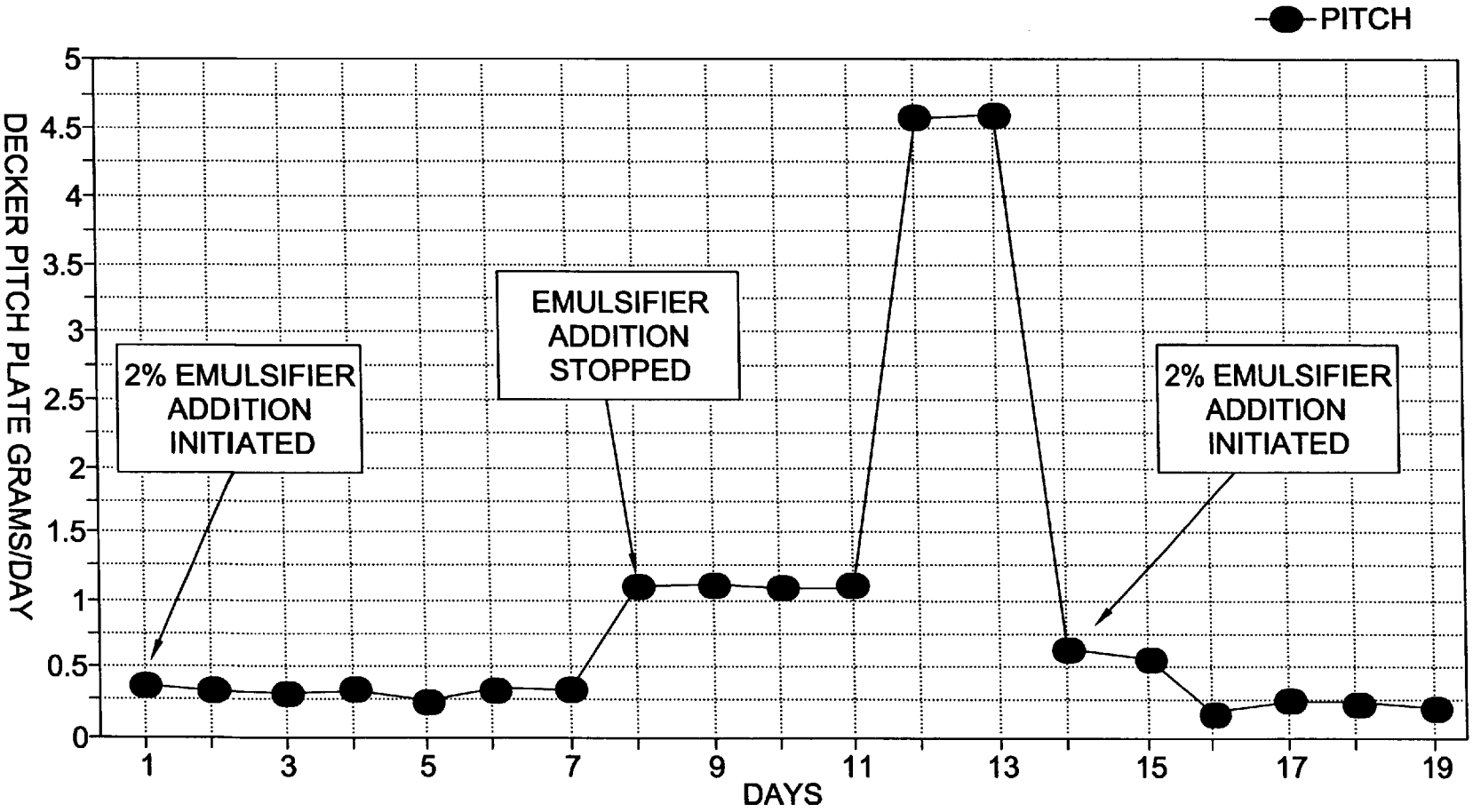
Figure 10:
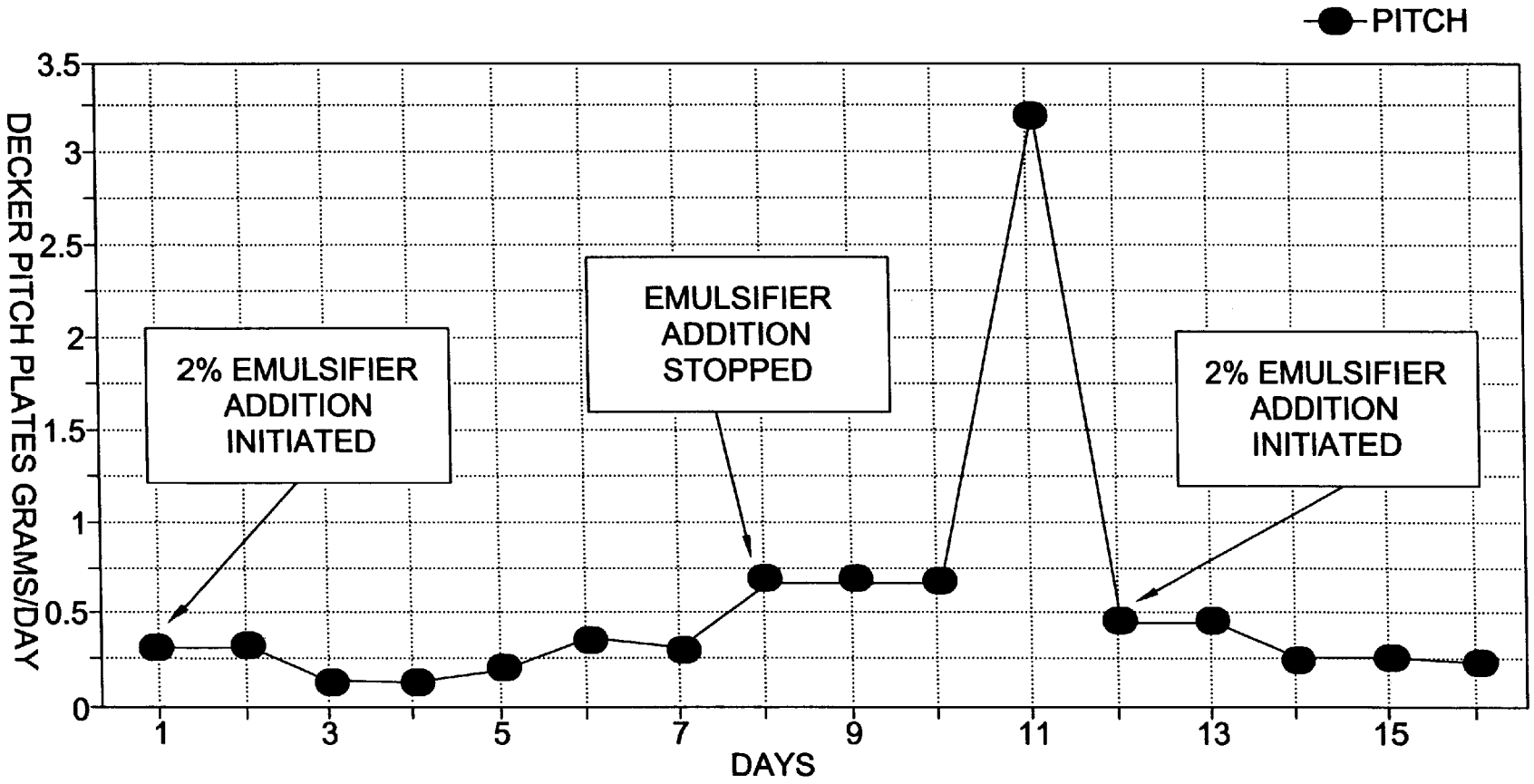

Another major benefit is the reduction in pitch plate deposition. The graphs of FIGS. 8–10 show that defoamer related pitch deposition on the pitch plate of a decker from the commercial size plant downstream of the brownstock washers operated as described above can be significantly reduced. This was due to the defoamer product being water soluble in the later stage. Therefore, the PX-94 had an affinity for the liquor and as a result washes away from the finished pulp with the counter-current liquor flow. Moreover, since the beginning of operation according to the present invention, a commercial size paper pulp operation had an average pitch plate deposition of 2.19 gms/day without the on-line added emulsifier and only 0.39 gms/day with the on-line added emulsifier. By adding the emulsifier on-line, the mill can take advantage of the highly insoluble, hydrophobic nature of the defoamer product in its normal state in the higher solids and hotter stages and change these characteristics as desired for the lower solids and cooler stages.

Example 3

This example tests the on-line emulsifying of the present invention in the laboratory on a CHEMIWASHER generated material. In this example, black liquor samples were taken from a commercial horizontal belt washer, known as a CHEMIWASHER apparatus. A CHEMIWASHER apparatus is a type of pulp washer. It employs a continuous moving belt having wash zones instead of a series of rotary screens.

In this example, the test device included a graduated cylinder having a top inlet and a bottom outlet. The cylinder was 80 mm wide and 300 mm tall. Tubing and a pump were provided to recycle liquor from the cylinder outlet back to the cylinder inlet. A POWERSTAT variable autotransformer LIUC (VARIAC) from Superior Electric Co. was provided to power the pump.

In this example, 200–500 mL of sample liquor was measured out in the graduated cylinder.

The dosage of defoamer required in a micro syringe was measured. The quantity of defoamer needed was generally between 50–500 milliliters.

The discharge tube was positioned in the center of the cylinder and the transformer was set to 60–100% power. The pump was started to cause the liquor to recycle.

The foam level then reached the desired foam height, primarily between 15–25 cm. The defoamer was then added by injection directly to the recycling CHEMIWASHER liquor stream and a stopwatch was started simultaneously to time the effect of defoamer.

The time (sec) and foam height (cm) at the lowest foam level after the defoamer injection was recorded as knockdown time and knockdown level, respectively.

The foam height was recorded in cm every 15 seconds for three minutes or until the foam level reached the top of the cylinder.

The parameters of the test were adjusted until the foam was knocked down at least 5 cm. The foam built up a minimum of 5 cm by the end of the test. The test was also adjusted so the foam reached to top of the tube or the highest stable foam height in between 60–180 seconds.

During these tests it was noted that increased defoamer dosage generally improved foam knockdown and increased the length of the test. The converse is true when dosage was decreased.

Increased VARIAC settings normally counteracted foam knockdown and shorted the foam test. While decreasing the motor speed had the opposite effect on the test. The amount of liquor sample added to the test cylinder affected the test in a more unpredictable manner.

For this example, samples were taken from the forming zone, the third stage, and the fifth stage. Liquor properties are shown in Table 2. Two products that were better than a water extended defoamer of Calloway Chemical in the forming stage (Table 3) were chosen for testing on the later stages. Two percent emulsifier was added to FLEETCOL PS-16 water extended defoamer available from Rhone Poulenc and FLEETCOL QP-100 water extended defoamer available from Rhone Poulenc, and then compared to the regular products in standard foam cell tests.

TABLE 2

CHEMIWASHER Liquor Properties

| Source | Solids | pH | Conductivity | Temperature |
|---|---|---|---|---|
| Forming Zone | 13.0% | 12.5 | 72,400 micromhos | 185° F. |
| Third Stage | 1.7% | 12.4 | 14,830 micromhos | 165° F. |
| Fifth Stage | 0.3% | 11.6 | 4,210 micromhos | 145° F. |

As a result of this example, the third stage showed little or no benefit with emulsifier, at least in these laboratory tests. PS-16 defoamer showed some improvement in the middle part of the test, but no change in knockdown (Table 4) QP-100 defoamer showed a slight decrease in knockdown with the emulsifier, but the later persistence was the same (Table 5).

Tests on the fifth stage showed faster knockdown for both products with emulsifier (Tables 6 and 7). This may indicate faster spreading into the black liquor. PS-16 then showed better performance to about 45 seconds, at which it was then close to the behavior of the standard version (Table 6). QP-100 showed much better performance until around 45 seconds and was then close to but slightly behind the non-emulsified version (Table 8).

This example indicates foam cell tests on black liquor samples from this mill indicate adding emulsifier to a defoamer can help it spread into the liquor faster in the later stages.

It should be apparent that many modifications may be made to the above-describe embodiments while remaining within the spirit and scope of the present invention.

TABLE 3

Foam Heights (cm) of Liquor from CHEMIWASHER Forming Zone Liquor Tested at a Temperature of 185° F., pH of 12.5, Conductivity of 72,400 $\mu$m hos, Emulsifiers at level of 200 $\mu$L'S

| Time (sec) | 0 | 4 | 5 | 6 | 15 | 30 |
|---|---|---|---|---|---|---|
| Foam Height with Competitor (cm) | 24.0 | | 12.5 | | 13.1 | 16.4 |
| Foam Height with PS-16 (cm) | 24.0 | 11.7 | | | 13.2 | 16.4 |
| Foam Height with QP-100 (cm) | 24.0 | | | 12.2 | 12.4 | 14.2 |
| **Time (sec)** | **45** | **60** | **75** | **90** | **105** | **120** |
| Foam Height with Competitor (cm) | 20.6 | 23.5 | 25.3 | 26.3 | 26.9 | 27.4 |
| Foam Height with PS-16 (cm) | 19.5 | 22.7 | 23.1 | 24.5 | 25.7 | 26.7 |
| Foam Height with QP-100 (cm) | 16.1 | 18.3 | 20.5 | 22.3 | 23.4 | 24.0 |

TABLE 4

Foam Heights (cm) of Liquor from CHEMIWASHER Third Stage Liquor Tested at a Temperature of 165° F., pH of 12.4, Conductivity of 14,830 $\mu$m hos, Emulsifiers at level of 150 $\mu$L'S

| Time (sec) | 0 | 6 | 7 | 15 | 30 | 45 |
|---|---|---|---|---|---|---|
| Foam Height with PS-16 (cm) | 24.0 | 11.8 | | 12.3 | 15.4 | 19.6 |
| Foam Height with PS-16 (2% OLE) (cm) | 24.0 | | 11.8 | 12.6 | 16.1 | 19.3 |

TABLE 4-continued

Foam Heights (cm) of Liquor from CHEMIWASHER Third Stage Liquor Tested at a Temperature of 165° F., pH of 12.4, Conductivity of 14,830 μm hos, Emulsifiers at level of 150 μL'S

| Time (sec) | 60 | 75 | 90 | 105 | 120 | 135 | 150 |
|---|---|---|---|---|---|---|---|
| Foam Height with PS-16 (cm) | 23.2 | 25.0 | 25.9 | 26.5 | 27.7 | 28.4 | |
| Foam Height with PS-16 (2% OLE) (cm) | 21.3 | 22.6 | 24.6 | 25.6 | 27.2 | 27.9 | 28.4 |

TABLE 5

Foam Heights (cm) of Liquor from CHEMIWASHER Third Stage Liquor Tested at a Temperature of 165° F., pH of 12.4, Conductivity of 14,830 μm hos, Emulsifiers at level of 150 μL'S

| Time (sec) | 0 | 7 | 8 | 15 | 30 | 45 |
|---|---|---|---|---|---|---|
| Foam Height with QP-100 (cm) | 24.0 | | 12.2 | 12.2 | 12.7 | 15.8 |
| Foam Height with QP-100 (2% OLE) (cm) | 24.0 | 13.0 | | 13.0 | 13.6 | 16.6 |

| Time (sec) | 60 | 75 | 90 | 105 | 120 | 135 | 150 |
|---|---|---|---|---|---|---|---|
| Foam Height with QP-100 (cm) | 19.5 | 22.2 | 23.7 | 25.0 | 25.6 | 27.2 | 28.0 |
| Foam Height with QP-100 (2% OLE) (cm) | 20.0 | 22.1 | 23.5 | 24.8 | 26.3 | 27.5 | 28.0 |

TABLE 6

Foam Heights (cm) of Liquor from CHEMIWASHER Fifth Stage Liquor Tested at a Temperature of 145° F., pH of 11.6, Conductivity of 4,210 μmhos, Emulsifiers at level of 100 μL'S

| Time(sec) | 0 | 4 | 8 | 15 | 30 | 45 |
|---|---|---|---|---|---|---|
| Foam Height with PS-16 (cm) | 16.0 | | 10.4 | 10.9 | 12.2 | 12.7 |
| Foam Height with PS-16 (2% OLE) (cm) | 16.0 | 10.0 | | 10.4 | 11.5 | 12.5 |

| Time (sec) | 60 | 75 | 90 | 105 | 120 | 135 |
|---|---|---|---|---|---|---|
| Foam Height with PS-16 (cm) | 13.7 | 14.3 | 14.9 | 15.6 | 16.1 | 16.7 |
| Foam Height with PS-16 (2% OLE) (cm) | 13.4 | 14.1 | 14.6 | 15.3 | 15.7 | 16.3 |

TABLE 7

Foam Heights (cm) of Liquor from CHEMIWASHER Fifth Stage Liquor Tested at a Temperature of 145° F., pH of 11.6, Conductivity of 4,210 μmhos, Emulsifiers at level of 100 μL'S

| Time (sec) | 0 | 5 | 8 | 15 | 30 | 45 |
|---|---|---|---|---|---|---|
| Foam Height with QP-100 (cm) | 16.0 | | 10.6 | 11.2 | 11.9 | 12.5 |
| Foam Height with QP-100 (2% OLE) (cm) | 16.0 | 10.2 | | 10.5 | 11.6 | 12.6 |

| Time (sec) | 60 | 75 | 90 | 105 | 120 | 135 |
|---|---|---|---|---|---|---|
| Foam Height with QP-100 (cm) | 13.3 | 14.0 | 14.7 | 15.3 | 15.9 | 16.7 |
| Foam Height with QP-100 (2% OLE) (cm) | 13.5 | 14.4 | 15.2 | 15.7 | 16.4 | 17.0 |

It should be apparent that embodiments other than those specifically described above come within the spirit and scope of the present invention. Thus, the present invention is not defined by the above description, but rather is defined by the claims appended hereto.

We claim:

1. A process for treating paper pulp at a paper manufacturing site, comprising the steps of:

feeding paper pulp into a cleaning device comprising at least two washing stages;

producing a first mixture at the manufacturing site comprising a defoamer;

feeding the first mixture into a first washing stage;

producing a second mixture at the manufacturing site comprising an emulsifier, the second mixture having a weight ratio of emulsifier to defoamer that is greater than the weight ratio of emulsifier to defoamer in the first mixture;

feeding the second mixture into a second washing stage, the second washing stage being downstream from the first washing stage relative to the direction of paper pulp travel; and adjusting the weight ratio of emulsifier to defoamer in the first mixture or second mixture.

2. The process according to claim 1, wherein a washing fluid passes through the washing stages countercurrent to the direction of paper pulp travel.

3. The process according to claim 1, wherein the step of feeding paper pulp into a cleaning device comprises feeding paper pulp into a cleaning device comprising three or four washing stages and a different weight ratio of emulsifier to defoamer is fed to each washing stage.

4. The process according to claim 1, wherein each of the washing stages has an emulsifier concentration on a per weight basis and the lowest emulsifier concentration passing into any of the stages is at most 0 to 30% of the emulsifier concentration passed into the stage being fed the highest emulsifier concentration.

5. The process according to claim 1, wherein each of the washing stages has an emulsifier concentration and the emulsifier concentration does not decrease from one washing stage to the next washing stage relative to the direction of paper pulp travel.

6. The process according to claim 1, wherein the second mixture includes emulsifier in an amount from 0.2 to 20% by weight.

7. The process according to claim 1, wherein the second mixture includes emulsifier in an amount from 1 to 5% by weight.

8. The process according to claim 1, wherein the second mixture includes emulsifier in an amount from 1 to 3% by weight.

9. The process according to claim 1, wherein the cleaning device is a rotary screen brownstock washer.

10. The process according to claim 1, wherein the cleaning device is a horizontal belt washer.

11. A process for treating paper pulp at a paper manufacturing site, comprising the steps of:

feeding paper pulp into a cleaning device comprising at least two washing stages, said cleaning device including a washing fluid that passes through the washing stages countercurrent to the direction of paper pulp travel;

producing a mixture at the manufacturing site comprising at least one of a defoamer and an emulsifier for each of the washing stages, each of the mixtures having a different weight ratio of emulsifier to defoamer;

feeding the mixtures to each of said washing stages such that the weight ratio of emulsifier to defoamer increases from one washing stage to the next washing stage relative to the direction of paper pulp travel; and adjusting the weight ratio of emulsifier to defoamer in at least one mixture.

12. A process for treating paper pulp at a paper manufacturing site, comprising the steps of:

feeding paper pulp into a cleaning device comprising at least two washing stages;

producing a mixture at the manufacturing site comprising at least one of a defoamer and an emulsifier for each of the washing stages;

feeding the mixtures to each of said washing stages; and adjusting the weight ratio of emulsifier to defoamer in at least one mixture.

13. The process according to claim 12, wherein the step of feeding paper pulp into a cleaning device comprises feeding paper pulp into a cleaning device comprising three or four washing stages.

* * * * *

UNITED STATES PATENT AND TRADEMARK OFFICE
CERTIFICATE OF CORRECTION

PATENT NO. : 6,162,325

DATED : December 19, 2000

INVENTOR(S) : Raslack et al.

It is certified that error appears in the above-identified patent and that said Letters Patent is hereby corrected as shown below:

Title page, insert the following:

--Related U.S. Application Data

Provisional Application No. 60/030,556 Nov. 14, 1996--.

Title page, [56] References Cited, U.S. PATENT DOCUMENTS, line 1, "3,567,754" should read --3,567,574--.

Signed and Sealed this

Eighth Day of May, 2001

*Attest:*

Nicholas P. Godici

NICHOLAS P. GODICI

*Attesting Officer*

*Acting Director of the United States Patent and Trademark Office*